US009010352B2

(12) United States Patent
Takanohashi

(10) Patent No.: US 9,010,352 B2
(45) Date of Patent: Apr. 21, 2015

(54) SOCKET STRUCTURE

(75) Inventor: Toshiyuki Takanohashi, Saitama (JP)

(73) Assignee: Surpass Industry Co., Ltd., Saitama (JP)

( * ) Notice: Subject to any disclaimer, the term of this patent is extended or adjusted under 35 U.S.C. 154(b) by 375 days.

(21) Appl. No.: 12/911,867

(22) Filed: Oct. 26, 2010

(65) Prior Publication Data

US 2011/0100481 A1 May 5, 2011

(30) Foreign Application Priority Data

Nov. 4, 2009 (JP) ..... 2009-252901

(51) Int. Cl.
*B67D 1/04* (2006.01)
*B67D 1/08* (2006.01)
*B67D 7/02* (2010.01)

(52) U.S. Cl.
CPC ..... *B67D 7/0294* (2013.01)

(58) Field of Classification Search
CPC ..... B67D 7/0294; B67D 7/0266; B67D 1/04; B67D 1/0835
USPC ..... 137/145, 212, 551, 553, 151, 152, 137/315.01, 317, 320, 322; 285/93
See application file for complete search history.

(56) References Cited

U.S. PATENT DOCUMENTS 655,672 A * 8/1900 Engel ..... 137/212
2,018,543 A * 10/1935 Buirk ..... 137/212
2,097,063 A * 10/1937 Heller ..... 137/375
2,104,467 A * 1/1938 Marzolf ..... 62/166
3,198,405 A * 8/1965 Pfeil ..... 222/400.8
3,348,805 A * 10/1967 Sanctuary ..... 251/315.05
3,353,724 A * 11/1967 Johnston ..... 222/400.7
3,357,602 A * 12/1967 Sichler ..... 222/400.7
3,905,522 A * 9/1975 Johnston ..... 222/400.7
5,108,015 A * 4/1992 Rauworth et al. ..... 222/400.7

(Continued)

FOREIGN PATENT DOCUMENTS

JP 2000-230686 8/2000
JP 2002-192150 A 7/2002

(Continued)

OTHER PUBLICATIONS

Office Action issued on Sep. 24, 2013, by the Japanese Patent Office in connection with Japanese Application No. 2009-252901 (only in Japanese) 2 pages.

*Primary Examiner* — Atif Chaudry
(74) *Attorney, Agent, or Firm* — Robert P. Michal; Lucas & Mercanti LLP

(57) ABSTRACT

Provided is a socket structure capable of preventing or inhibiting defective attachment/detachment thereof and defective movement and defective sealing of a valve mechanism due to a solid deposit caused by a fluid. A socket used by connecting the socket to a plug of a connector includes a socket body in which a channel is formed and which has a valve mechanism; and a sleeve which is disposed so as to be slidable in an axial direction thereof and rotatable along an outer circumferential surface of the socket body. The socket is configured to be screwed and secured by inserting and connecting an entrance of the channel that opens at a lower end of the socket body to a plug exit that opens at an upper end of the plug and then a sleeve thread portion is screwed into a socket female thread portion by rotating the sleeve.

8 Claims, 6 Drawing Sheets

(56) References Cited

U.S. PATENT DOCUMENTS 6,640,457 B2 * 11/2003 Williams et al. ..... 33/501.45
6,848,466 B2 * 2/2005 Durand ..... 137/315.04

FOREIGN PATENT DOCUMENTS

JP 2005-508730 A 4/2005
WO WO 03/006359 A 1/2003

* cited by examiner

SOCKET STRUCTURE

BACKGROUND OF THE INVENTION

1. Field of the Invention

The present invention relates to a socket structure used by connecting it to a plug of a connector attached to a nozzle of a vessel containing a fluid such as a chemical solution.

This application is based on Japanese Patent Application No. 2009-252901, the content of which is incorporated herein by reference.

2. Description of Related Art

In general, a liquid such as a semiconductor high-purity chemical or a general chemical is charged into a vessel, such as a tank, at a manufacturing plant and is shipped with a cap (lid) fitted to an opening formed in the vessel.

To take the liquid, stored in the vessel, out of the vessel, the cap is detached from the nozzle opening of the vessel, and a connector equipped with a siphon tube long enough to reach the bottom of the vessel is attached to the nozzle opening of the vessel. The connector has a plug to which the siphon tube is connected. After the attachment of the connector is completed, a socket having a liquid feed hose is attached to the plug of the connector, and the liquid in the vessel is taken out from the siphon tube through the plug, the socket, and the liquid feed hose by suction using a pump or pressure using pressurized gas.

To take the liquid out of the vessel by suction using a pump, an inert gas such as nitrogen is supplied to the vessel through a gas feed hose to compensate for a negative pressure occurring in the vessel. On the other hand, to push the liquid out of the vessel by pressure using pressurized gas, an inert gas such as nitrogen is supplied as the pressurized gas to the vessel through the gas feed hose.

Examples of structures for connecting the gas feed hose described above include a structure in which a socket for connecting the gas feed hose is attached by providing a dedicated nozzle opening in the vessel and a structure in which a gas feed hose connection port and a gas channel are formed in the socket for the liquid feed hose so that the nozzle opening is shared by the liquid and the gas.

The socket described above has a valve mechanism that opens and closes a liquid channel. A socket having a valve mechanism in the related art includes a sleeve and an inner cylinder inserted into the sleeve, with the valve mechanism disposed in the inner cylinder.

In this case, the valve mechanism includes a sliding cylinder, and the middle portion of the sliding cylinder is cylindrical bellows formed integrally with the other portion. Thus, because the bellows are formed in the middle portion of the sliding cylinder integrally with the other portion, it is possible to eliminate the labor and cost of bonding the bellows to the other portion while taking sealing performance into account and to reliably prevent leakage of, for example, liquid from the bellows over an extended period of time. For the joint between the socket and the plug, a ball lock mechanism that operates during attachment/detachment is employed (see, for example, Japanese Unexamined Patent Application, Publication No. 2000-230686).

BRIEF SUMMARY OF THE INVENTION

Fluids handled using the socket described above include liquids that tend to adhere and solidify, such as slurry-like chemical solutions. If such a liquid adheres to and solidifies at, for example, a working portion or thread portion of a ball lock mechanism or a valve mechanism, the solid deposit obstructs its smooth movement.

For example, if a liquid adheres to and solidifies at balls of a ball lock mechanism, the balls cannot roll smoothly, thus making it difficult to attach or detach the socket. If liquid adhering to a spring or bellows solidifies, the liquid obstructs its smooth deformation movement and also narrows the range of deformation. In addition, if liquid adhering to a thread portion solidifies, the solid deposit obstructs its smooth screwing, thus making it difficult to achieve a joint or seal by complete screwing.

Against this backdrop, it is desirable for a socket connected to a plug of a vessel for taking a fluid out of the vessel to prevent or inhibit obstruction of the attachment/detachment thereof and the movement and sealing function of, for example, a valve mechanism by a solid deposit of the fluid being handled, thus allowing an easy and reliable attachment/detachment procedure.

An object of the present invention, which has been made in light of the above circumstances, is to provide a socket structure capable of preventing or inhibiting defective attachment/detachment thereof and defective movement and defective sealing of a valve mechanism due to a solid deposit formed as a fluid being handled adheres and solidifies, thus providing superior ease of manipulation with which the socket structure can be easily and reliably connected to a plug.

To solve the above problem, the present invention employs the following solutions.

A socket structure according to an aspect of the present invention is used by connecting the socket structure to a plug of a connector disposed at an outlet opening of a vessel for taking a fluid out of the vessel for transfer. The socket structure includes a socket body in which a channel for the fluid is formed and which has a valve mechanism; and a sleeve in which the socket body is disposed along a central axis thereof and which is disposed so as to be slidable in an axial direction thereof and rotatable along an outer circumferential surface of the socket body. The socket structure is configured to be screwed and secured by inserting and connecting an entrance of the channel that opens at a lower end of the socket body to a plug exit that opens at an upper end of the plug and then rotating the sleeve while sliding the sleeve downward so that a sleeve thread portion is screwed into a thread portion on the vessel side.

The socket structure according to the above aspect of the present invention includes the socket body in which the channel for the fluid is formed and which has the valve mechanism; and the sleeve in which the socket body is disposed along the central axis thereof and which is disposed so as to be slidable in the axial direction thereof and rotatable along the outer circumferential surface of the socket body. The socket structure is configured to be screwed and secured by inserting and connecting the entrance of the channel that opens at the lower end of the socket body to the plug exit that opens at the upper end of the plug and then rotating the sleeve while sliding the sleeve downward so that the sleeve thread portion is screwed into the thread portion on the vessel side. This allows attachment/detachment of the socket while preventing obstruction of the attachment/detachment action due to a solid deposit formed at a joint between the socket and the connector, for example, as liquid remaining in the socket drips on and adheres to the joint.

That is, because the entrance of the channel that opens at the lower end of the socket body is inserted (plugged) into and connected to the plug exit that opens at the upper end of the plug, liquid remaining in the socket downstream of the valve mechanism when the valve mechanism is closed reliably falls into the vessel without dripping on and adhering to the joint.

In the invention described above, a position where the sleeve thread portion is screwed into the thread portion on the vessel side is preferably set to be higher than a position where the entrance of the channel is connected to the plug exit. This prevents or inhibits liquid dripping from the socket upon detachment of the socket from the connector from adhering to the sleeve thread portion and the thread portion on the vessel side.

In the invention described above, a screwing completion indicator is preferably provided on the outer circumferential surface of the lower end of the socket body so that the screwing completion indicator is exposed when the sleeve thread portion is screwed to a predetermined position in the thread portion on the vessel side. This allows the operator who screws and secures the sleeve to easily determine that the sleeve is screwed by an appropriate amount by visually checking the screwing completion indicator.

In the invention described above, a tapered surface, for forming a working space, whose diameter decreases toward a lower end thereof is preferably provided in an outer circumferential surface of a lower end of the sleeve. This ensures a sufficient working space where the operator can put his or her hands to manipulate the sleeve during the procedure.

In the invention described above, the socket body preferably has a plurality of gas channels provided around the channel. This allows the gas channels to have a sufficient channel cross-sectional area so that the liquid can be drawn out (taken out) by exposure to air.

The present invention described above provides a socket structure capable of preventing or inhibiting obstruction of attachment to and detachment from a connector and the movement and sealing function of, for example, a valve mechanism provided on a socket body due to a solid deposit formed, for example, as the fluid being handled drips and adheres thereto, thus allowing an easy and reliable attachment/detachment procedure.

DETAILED DESCRIPTION OF THE INVENTION

An embodiment of a socket structure according to the present invention will be described below on the basis of the drawings.

The socket structure of the present invention is a tool used by connecting it to a plug of a connector disposed at an outlet opening of a vessel for taking a fluid out of the vessel for transfer. In this case, the fluid is, for example, a petroleum product, an industrial chemical, a paint, or a medical product; a semiconductor high-purity chemical or a general chemical is assumed to be handled in the description below, although the fluid used is not limited thereto.

Figure 2:
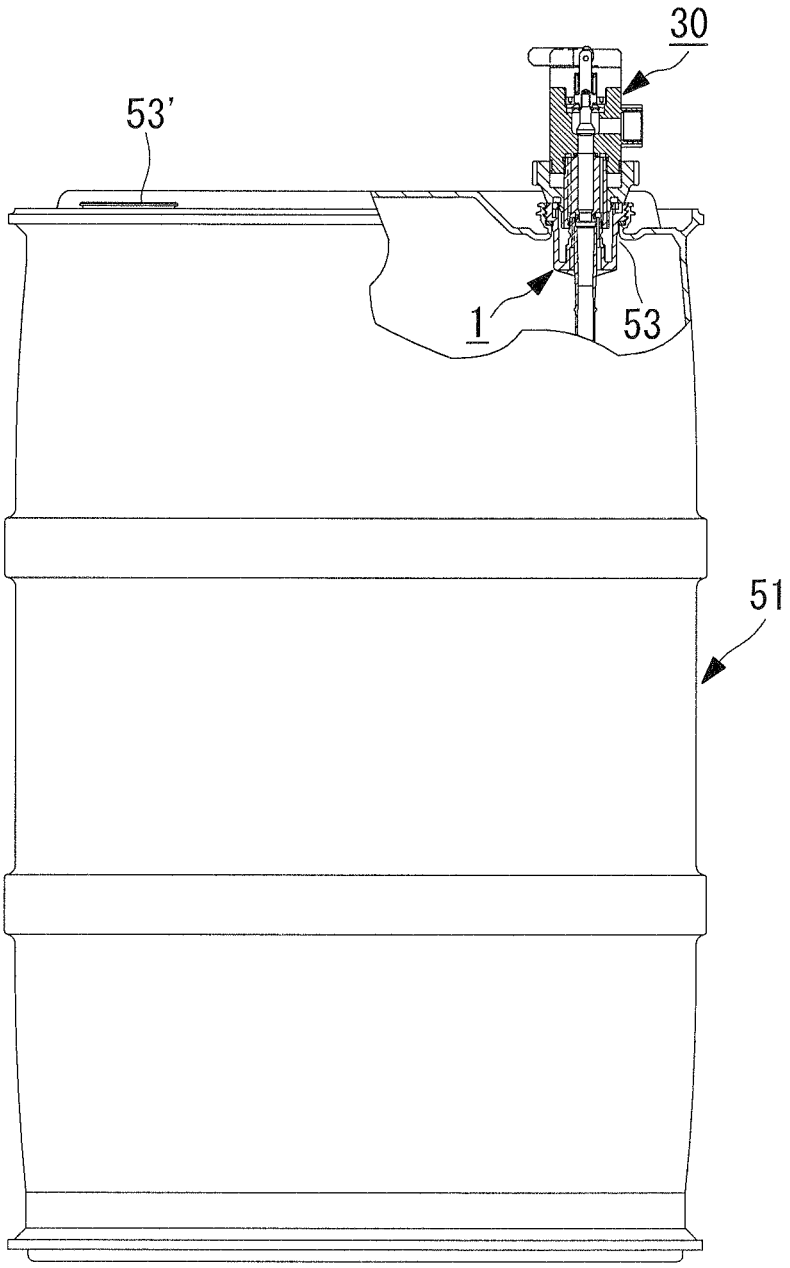
FIG. 2 is a partially sectional view schematically showing the state where the connector and the socket are attached to an opening of a vessel.
Figure 3:
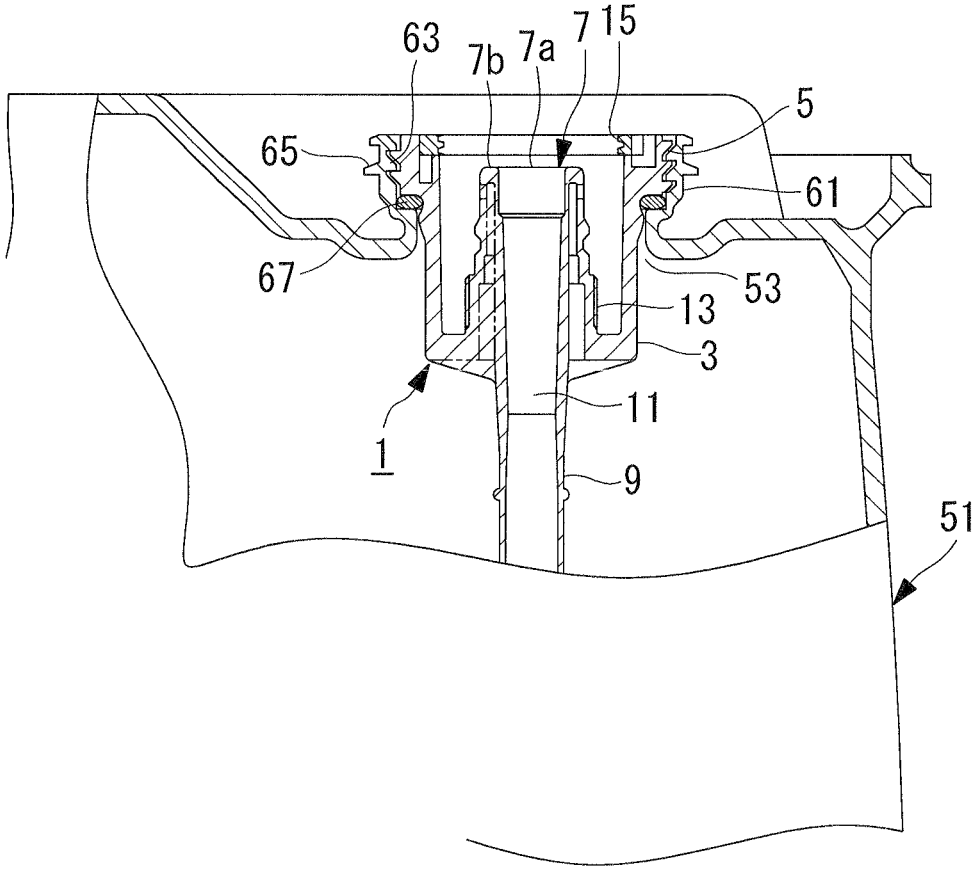
FIG. 3 is an enlarged sectional view of a relevant part of the vessel shown in FIG. 2, showing the state where the connector is attached to the opening of the vessel.

FIGS. 2 and 3 are diagrams showing a connector 1 attached to a vessel 51, illustrating a constructive example of the case where a common connector is used for a liquid feed hose for drawing out liquid and a gas feed hose for taking in gas.

As shown in FIG. 2, two openings 53 and 53' are formed in the top surface of the vessel 51 storing a liquid. The connector 1 and a socket 30 used in common for drawing out the liquid and taking in a gas are attached to one opening 53, and the other opening 53' is sealed with a cap. The intake of the gas into the vessel 51 is for supplying the gas to the vessel 51 from which the liquid is being drawn so that the liquid can be smoothly drawn out.

Thus, the connector 1 and the socket 30 of this embodiment do not use the other opening 53' provided in the vessel 51; the gas feed hose is connected to a gas communicating system provided in the socket 30 for drawing out the liquid to supply a gas (inert gas) such as nitrogen gas to the vessel 51. It is also possible to attach a dedicated connector and socket for drawing out liquid to one opening 53 and to attach a dedicated connector and socket for communicating gas to the other opening 53'.

A concave portion curved in a concave shape of a curved surface is formed in the bottom surface of the vessel 51, and this concave portion is the deepest position of the vessel 51. The deepest position, that is, the position where the concave portion is formed, is, for example, but is not limited to, the center of the bottom surface.

FIG. 3 is an enlarged view showing the connector 1 attached to the opening 53 of the vessel 51.

The socket 30 having the hose (not shown) is detachably attached to the connector 1 so that the liquid can be taken out of the vessel 51 by suction using, for example, a pump disposed at the other end of the hose.

The connector 1 shown mainly includes a connector body 3, serving as the main body of the connector 1, a plug 7, serving as a portion to be coupled to the socket 30 described above, and a siphon tube 9 secured to the plug 7 and extending toward the interior of the vessel 51. A cylindrical nozzle 61 is an opening formed in the vessel 51 for taking the liquid out.

The connector body 3 is formed substantially in a cylindrical shape with a closed bottom, and the plug 7 is formed integrally with the interior thereof. A joint portion (outer thread portion) 5 joined to the vessel 51 by screwing it into a female thread portion 63 formed in the cylindrical nozzle 61 of the vessel 51 is provided around the open end of the connector body 3.

In this case, the siphon tube 9 is curved at an angle of about 90° toward substantially the horizontal direction so that the lower side thereof extends along the bottom surface of the vessel 51, and an open end thereof is open sideward near the deepest position of the concaved portion described above. In the vessel 51 shown, the female thread portion 63 for the connector 1 is formed in the inner circumferential surface of the cylindrical nozzle 61, and a securing portion 65 for attaching a vessel cap (not shown) for sealing the vessel 51 is formed in the outer circumferential surface of the cylindrical nozzle 61. In the drawings, reference numeral 67 is an O-ring for sealing.

The plug 7 is formed in a substantially cylindrical shape having a plug exit 7*a* that opens at the upper end thereof, and is formed integrally with the bottom surface (lower surface in the drawings) of the connector body 3. A communicating hole 11 for communicating the liquid is formed inside the plug 7. A cap thread portion 13 to be screwed into a plug cap (not shown) for preventing the liquid from flowing out is formed on the outer circumferential surface of the plug 7 on the lower side thereof in the drawings. The plug cap is a component that is detached from the plug 7 when the socket 30 is attached to the connector 1 and, in other cases, is attached to the plug 7 to prevent the liquid from flowing out.

The siphon tube 9 described above, which is a tube-shaped member, is connected to the lower end of the plug 7 and communicates with the communicating hole 11 so as to form a liquid channel for taking the liquid out from an open end thereof.

In addition, a socket female thread portion 15 for securing the socket 30, described later, is formed in the upper opening of the connector body 3 described above.

Figure 1:
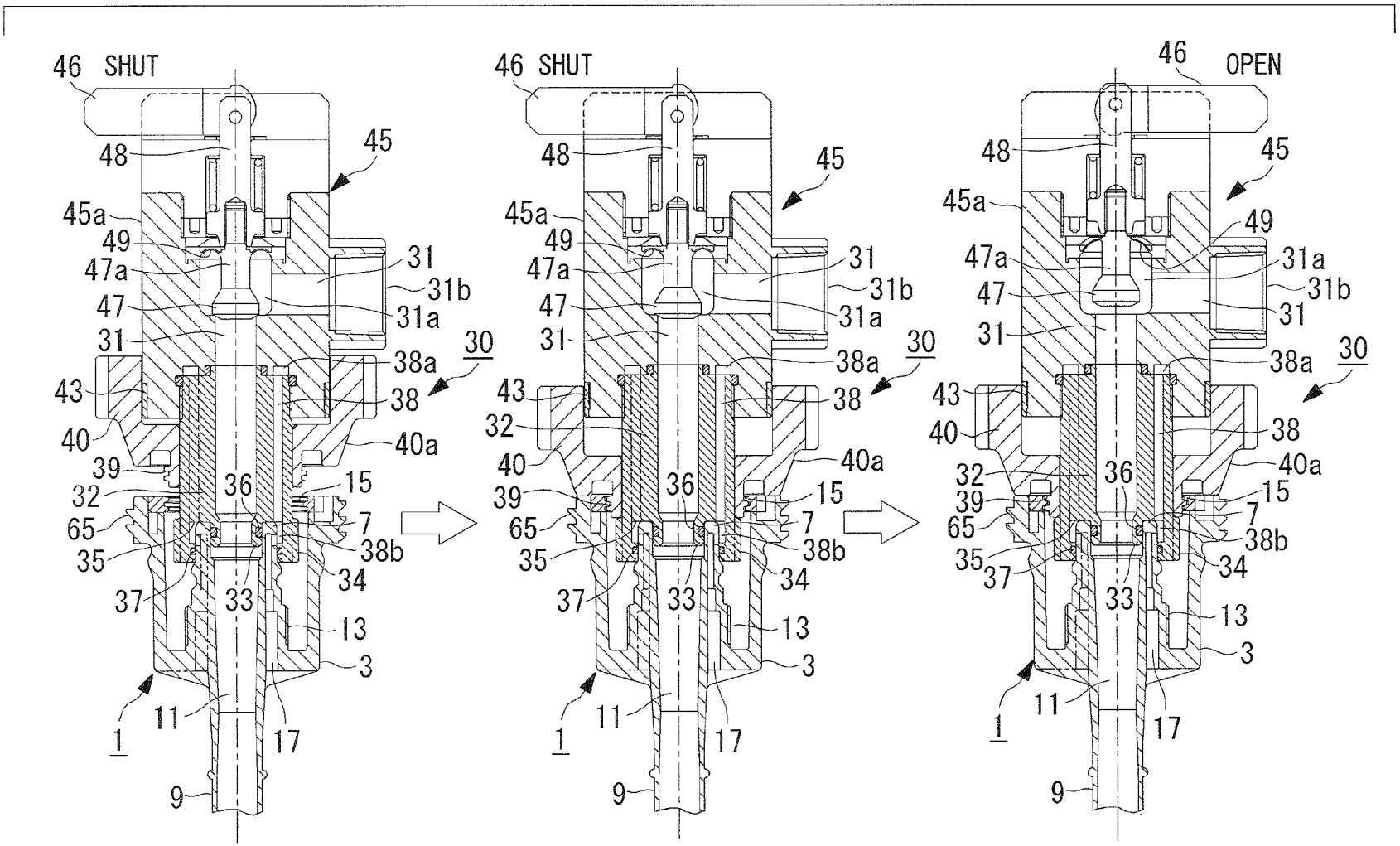
FIG. 1 is a sectional view of an embodiment of a socket structure according to the present invention, showing, in order from the left in the arrow direction, the state where a socket having a hand-operated valve in a closed state is connected to a plug of a connector, the state where the socket is secured to the connector by screwing a sleeve (the valve is closed), and the state where the socket is secured to the connector and the valve is opened.

In the first embodiment shown in FIG. 1, the socket 30 is used by connecting it to the plug 7 of the connector 1 disposed at the opening 53 serving as the liquid outlet of the vessel 51 for taking the liquid out of the vessel 51 for transferring it.

This socket 30 includes a socket body 32 in which a channel 31 for the liquid is formed and which has a valve mechanism 45; and a sleeve 40 in which the socket body 32 is disposed along the central axis thereof and which is disposed so as to be slidable in the axial direction thereof and rotatable along the outer circumferential surface of the socket body 32.

The socket 30 is screwed and secured to the vessel 51 by inserting and connecting the entrance of the channel 31 that opens at the lower end of the socket body 32 to the plug exit 7*a* that opens at the upper end of the plug 7, sliding the sleeve 40 downward, and rotating the sleeve 40 so that a sleeve thread portion 39 formed around the lower end of the sleeve 40 is screwed into the thread portion on the vessel 51 side, namely, the socket female thread portion 15 of the connector 1.

The socket body 32 is a substantially cylindrical member having the channel 31 formed along the central axis thereof.

Provided on the lower side of the socket body 32 are an insertion portion 33 having an outer diameter substantially equal to the inner diameter of the plug exit 7*a* that opens at the upper end of the plug 7 and an outer ring portion 34 having an inner diameter substantially equal to the outer diameter of the plug 7. That is, the lower side of the socket body 32 is formed in a double ring shape composed of the insertion portion 33 and the outer ring portion 34 so as to hold the inner and outer circumferential surfaces of the plug 7. A coupling surface 35 between the insertion portion 33 and the outer ring portion 34, which form the double ring shape, is placed on the upper end surface 7*b* of the plug 7 to limit the amount of insertion. In the drawings, reference numerals 36 and 37 are O-rings for providing a seal so that the liquid and the gas do not flow out on the inner and outer circumferential surfaces of the plug 7 inserted into the double ring.

The valve mechanism 45 is coupled to the upper side of the socket body 32 with O-rings disposed at appropriate positions. Hence, the socket body 32 in this embodiment includes a valve body 45*a* of the valve mechanism 45. The valve mechanism 45 shown is a hand-operated diaphragm valve configured to be opened and closed by manipulating a lever 46.

That is, as the lever 46 of the valve mechanism 45 is rotated by substantially 180°, a valve shaft 47*a* coupled to a valve element 47 disposed in the valve body 45*a* via an opening/closing link mechanism 48 is slid in the vertical direction. As a result, the valve element 47 undergoes opening/closing movement in the vertical direction in a valve chamber 31*a* in which the channel 31 formed inside the valve body 45*a* is bent by 90°. The channel 31, which is bent by 90° from the vertical direction to the horizontal direction, has a liquid feed nozzle 31*b*, protruding from the valve body 45*a*, to which the hose described above is connected.

The valve mechanism 45 is closed if the valve element 47 is lowered to close off the upper exit of the channel 31 formed in the vertical direction and is opened if the valve element 47 is raised to open the upper exit of the channel 31. At the top of the valve chamber 31*a* of the valve mechanism 45, the opening/closing link mechanism 48 coupled to the lever 46 is completely separated from the channel 31 for the liquid by a diaphragm 49. Thus, the diaphragm 49 vertically separates, in a liquid-tight manner, the valve-opening/closing mechanism from the channel 31 and the valve chamber 31*a*, through which the liquid flows.

The socket body 32 has a plurality of gas channels 38, for communicating the gas, provided around the channel 31 to supply the gas to the vessel 51. In the circular cross section of the socket body 32, the gas channels 38 are arranged at equal intervals in the circumferential direction so as to surround the channel 31 provided along the central axis. Although the necessary channel cross-sectional area can be provided using a single gas channel 38, this is undesirable because the socket body 32 becomes irregular in shape or large.

All gas channels 38 communicate with each other on the upper and lower sides thereof. An upper communicating gas channel 38*a* communicates with a gas feed nozzle (not shown), for connection to the gas feed hose, provided in, for example, the valve body 45*a*. A lower communicating gas channel 38*b* communicates with a plurality of gas channels 17 provided in the connector 1. Thus, the inert gas (vapor) supplied from the gas feed hose to the gas feed nozzle is divided into the plurality of gas channels 38 through the upper communicating gas channel 38*a*, flows into the lower communicating gas channel 38*b*, and flows into the vessel 51 through the plurality of gas channels 17 provided in the connector 1.

Preferably, the gas feed nozzle (not shown) is disposed in a direction different from that of the liquid feed nozzle 31*b* described above so that the gas feed hose and the liquid feed hose do not interfere with each other.

The thus-configured socket 30 is attached to the connector 1, which is attached in advance to the opening 53 of the vessel 51, to allow the liquid and the gas to be supplied to the vessel 51 by the following process. That is, in FIG. 1, the attachment of the socket 30 and the supply of the liquid are carried out in order from the left side of the page, as indicated by the empty arrows in the figure.

In the first step, the insertion portion 33 and the outer ring portion 34 formed at the lower end of the socket body 32, serving as the liquid inlet, are inserted into and connected to the plug exit 7*a* that opens at the upper end of the plug 7 of the connector 1. At this time, the insertion portion 33 and the outer ring portion 34 hold the inner and outer surfaces of the plug 7, and the coupling surface 35 abuts against the upper end surface 7*b* of the plug 7 to set the insertion position (amount of insertion). As a result, the communicating hole 11 of the plug 7 connected to the siphon tube 9 is coupled to the channel 31 of the socket 30. At this time, because the insertion portion 33 is inserted into the communicating hole 11 of the plug 7, the liquid reliably flows from the socket 30 down into the vessel 51 without flowing out from the joint between the plug 7 and the socket 30.

In the next step, the sleeve 40, which is provided around the socket body 32 and the valve body 45*a* so as to be rotatable as well as slidable in the vertical direction, is slid downward. Subsequently, the sleeve 40 is rotated in the screwing direction so that the sleeve thread portion 39 is screwed into the thread portion on the vessel 51 side, namely, the socket female thread portion 15 of the connector 1. As a result, the socket body 32 is secured to the vessel 51 by screwing.

At this time, a screwing completion indicator 43 may be provided at an appropriate position on the outer circumferential surface of the socket body 32 so that the screwing completion indicator 43 is exposed when the sleeve thread portion 39 is screwed to a predetermined position in the thread portion on the vessel 51 side, namely, the socket female thread portion 15. In this case, the screwing completion indicator 43 is provided on the outer circumferential surface of the lower end of the valve body 45*a* coupled to the socket body 32. The screwing completion indicator 43 may be provided by, for example, attaching a color ring different in color from the outer circumferential surface of the valve body 45*a* or the socket body 32.

Since the screwing completion indicator 43 is located at a position that is exposed when the sleeve 40 is screwed by an appropriate amount, the operator who screws and secures the sleeve 40 can visually check whether the screwing completion indicator 43 is exposed. This allows the operator to easily determine that the sleeve 40 is screwed to the appropriate position.

After the securing of the socket 30 is completed in this way, the lever 46 is rotated by substantially 180° from the left to the right to raise the valve element 47 in the channel 31 so that the valve mechanism 45 is opened. Since the valve mechanism 45 and the lever 46 for the opening/closing procedure are integrated with the socket 30, the liquid can be taken out by an opening/closing procedure in situ after completing the connection. Accordingly, upon starting of the operation of the pump connected to the other end of the liquid feed hose (not shown), the liquid is taken out of the vessel 51 from the siphon tube 9 through the communicating hole 11 and the channel 31 by suction.

At this time, the inert gas is supplied from the gas feed nozzle through the gas channels 38 to the vessel 51 to avoid a negative pressure in the vessel 51. Accordingly, the liquid flows smoothly out of the vessel 51. If the vessel 51 is formed of resin, deformation of the vessel 51 itself can be prevented. Since the plurality of gas channels 38 are provided, they ensure sufficient channel cross-sectional area, and the supply of the gas, such as an inert gas, can be replaced by introduction of air, depending on, for example, the flow rate at which the liquid is taken out.

After the procedure for taking the liquid out of the vessel 51 is completed in this way, the valve element 47 is lowered by manipulating the lever 46 so that the valve mechanism 45 is closed. As a result, the liquid remaining in the channel 31 downstream of the valve element 47 of the socket 30 flows in the direction opposite to the direction in which the liquid flows out, flows down into the vessel 51, and is collected therein. Since the valve mechanism 45 is integrated with the socket 30, little liquid remains in the channel 31.

Although a relatively small amount of liquid remaining in the socket 30 may drip during the attachment/detachment of the socket 30, the dripped liquid reliably falls into the vessel 51 because the entrance of the channel 31 that opens at the lower end of the socket body 32 is inserted (plugged) into and connected to the plug exit 7*a* that opens at the upper end of the plug 7. That is, because the insertion portion 33 is inserted into the communicating hole 11, the dripped liquid adheres to the lower end of the insertion portion 33. Accordingly, the action of detaching the socket 30 causes the dripped liquid to fall into the communicating hole 11, thus preventing or inhibiting it from adhering to the joint between the socket 30 and the connector 1.

If such dripped liquid adheres to, for example, a thread portion at a joint, the liquid solidifies at the joint and obstructs a predetermined attachment/detachment action. Preventing the dripped liquid from adhering to the joint avoids the problem with the attachment/detachment action, thus enabling an easy and reliable procedure. That is, the entrance of the channel 31 that opens at the lower end of the socket body 32 is inserted (plugged) into and connected to the communicating hole 11 through the plug exit 7*a* that opens at the upper end of the plug 7. Accordingly, the liquid remaining in the socket 30 downstream of the valve mechanism 45 when the valve mechanism 45 is closed reliably falls into the vessel 51 without dripping on and adhering to the joint.

In the structure of the embodiment described above, the position where the sleeve thread portion 39 is screwed into the thread portion on the vessel 51 side, namely, the socket female thread portion 15 of the connector 1, is set to be higher than the position where the entrance of the channel 31 is connected to the plug exit 7*a*. That is, because the position of the socket female thread portion 15 formed in the connector 1 is located higher than the plug exit 7*a*, even if the liquid drips from the socket 30 upon detachment of the socket 30 from the connector 1, the liquid can be prevented or inhibited from adhering to the sleeve thread portion 39 and the socket female thread portion 15, which are important for the attachment/detachment procedure.

In the embodiment described above, additionally, a tapered surface 40*a* whose diameter decreases toward the lower end thereof is provided in the outer circumferential surface of the lower end of the sleeve 40. This tapered surface 40*a* is intended to ensure a sufficient working space where the operator can put his or her hands to rotate the sleeve 40 during the attachment/detachment procedure. That is, forming the tapered surface 40*a* decreases the diameter of the sleeve 40 at the lower end thereof and correspondingly increases the surrounding working space.

Thus, the socket structure of the embodiment described above prevents or inhibits obstruction of attachment to and detachment from the connector 1 and the movement and sealing function of, for example, the valve mechanism 45 provided on the socket body 32 due to a solid deposit formed at the joint, for example, as the fluids being handled drips on and adheres to the joint, thus allowing an easy and reliable attachment/detachment procedure.

In addition, this socket structure is reliable in that a component whose movement is easily obstructed by solidified liquid, such as balls, bellows, or a spring, is not disposed in any portion in contact with the liquid.

The present invention is not limited to the embodiment described above; various modifications are permitted. Some modifications of the above-described embodiment according to the present invention will be described below on the basis of the drawings. The same portions as in the embodiment described above are denoted by the same reference numerals, and a detailed description thereof will be omitted.

Figure 4:
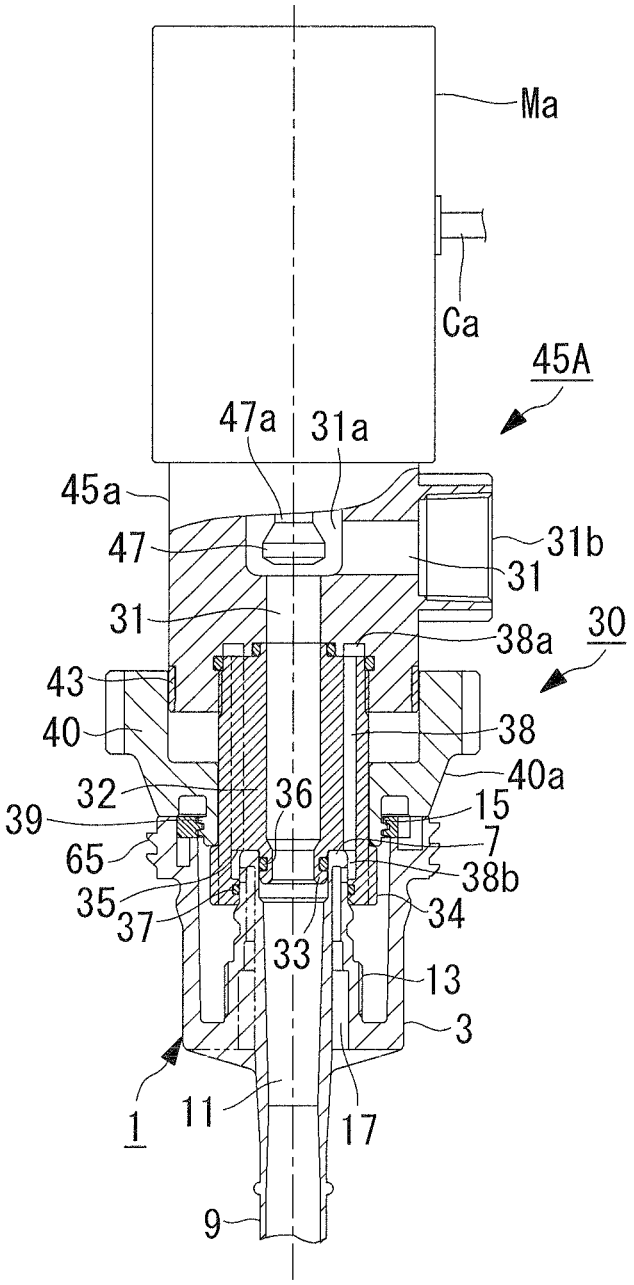
FIG. 4 is a sectional view of a relevant part of a first modification of the socket structure according to the present invention, showing the state where a socket having a motor-operated valve in an open state is connected to a plug of a connector.

First, a first modification will be described on the basis of FIG. 4. The first modification includes a motor-operated valve mechanism 45A including an electric actuator instead of the hand-operated system using the lever 46 in the embodiment described above. That is, the valve mechanism 45A of the first modification includes a motor mechanism Ma serving as an electric actuator. This motor mechanism Ma is connected to a control section (not shown) via a cable Ca for power supply and control. The valve mechanism 45A shown is open.

If the motor-operated valve mechanism 45A is used, the opening/closing of the valve mechanism 45A can be remotely controlled. This is effective for automation of various functions of the device including the valve mechanism 45A.

Figure 5:
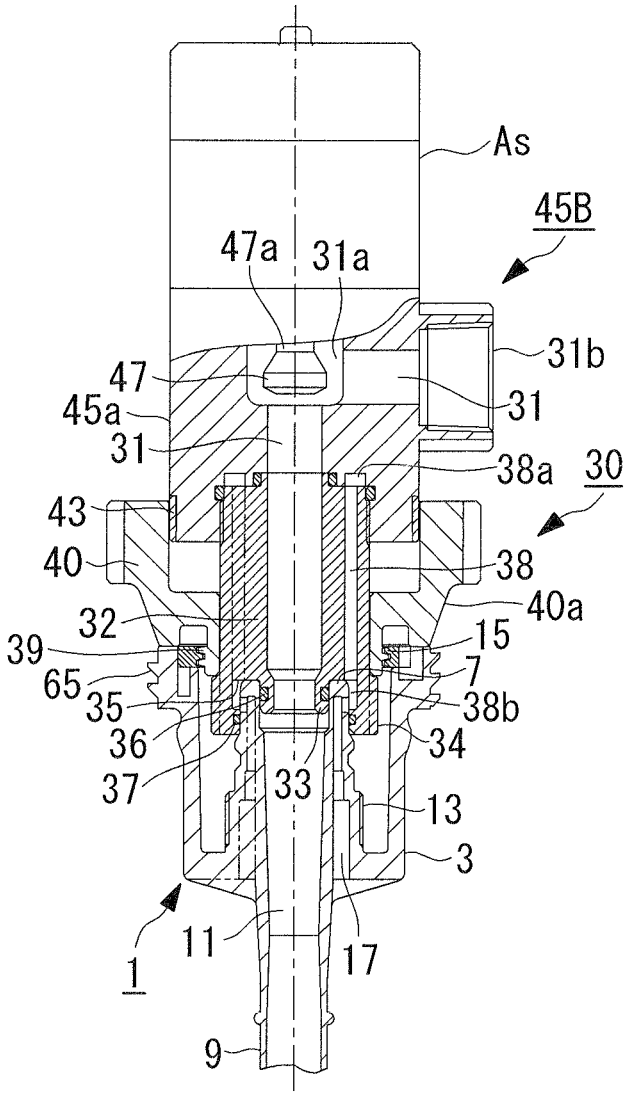
FIG. 5 is a sectional view of a relevant part of a second modification of the socket structure according to the present invention, showing the state where a socket having a pneumatically operated valve in an open state is connected to a plug of a connector.

Next, a second modification will be described on the basis of FIG. 5. The second modification includes a pneumatically operated valve mechanism 45B including a pneumatic actuator instead of the hand-operated system using the lever 46 in the embodiment described above. That is, the valve mechanism 45B of the second modification includes an air cylinder As serving as a pneumatic actuator. This air cylinder As is connected to an air pressure source (not shown) via an air pressure pipe (not shown) including an electromagnetic valve (not shown) that is opened and closed in response to a control signal output from a control section (not shown). The valve mechanism 45B shown is open.

If the pneumatically operated valve mechanism 45B is used, the opening/closing of the valve mechanism 45B can be remotely controlled by remote control of the opening/closing of the electromagnetic valve for switching on and off the supply of air pressure. This is effective for automation of various functions of the device including the valve mechanism 45B.

Finally, a third modification will be described on the basis of FIG. 6. The third modification includes a valve mechanism 45C using a plug valve instead of the diaphragm valve in the embodiment described above. That is, the valve mechanism 45C is opened and closed not by sliding the valve element 47 vertically, but by rotating a plug (valve element) 47A having a channel 47*b* by 90°. Although the modification shown is a motor-operated system using the motor mechanism Ma, a pneumatic actuator may be used instead.

Figure 6:
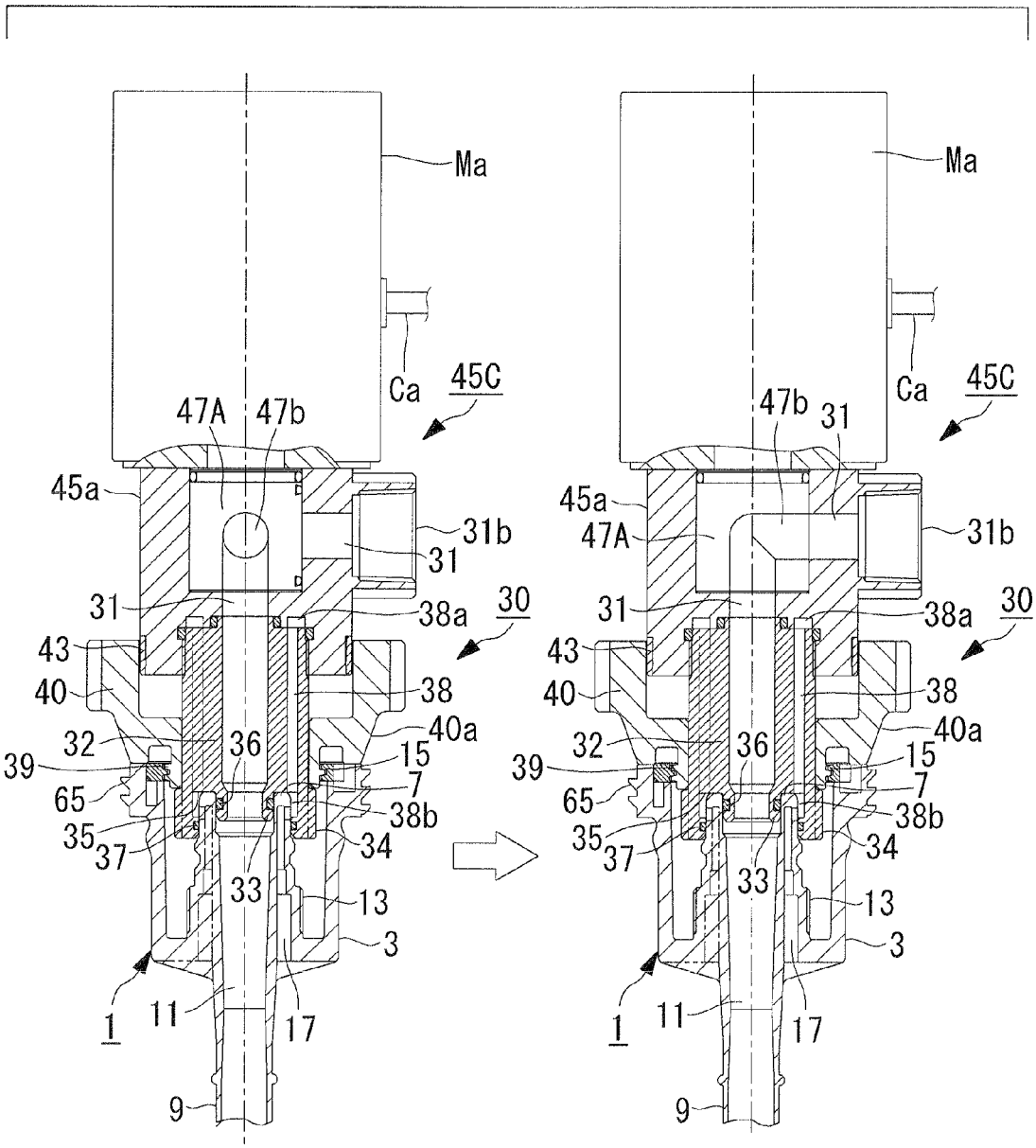
FIG. 6 is a sectional view of a third modification of the socket structure according to the present invention including a motor-operated plug valve connected to a plug of a connector, showing, in order from the left in the arrow direction, the state where the plug valve is closed and the state where the plug valve is open.

In FIG. 6, the left of the page shows a closed state where the channel 47*b* does not communicate with the channel 31. That is, the channel 31 of the socket body 32 is closed off by the portion of the plug 47A other than the channel 47*b*.

On the other hand, if the plug 47A is rotated by 90° in this state, both ends of the channel 47*b* meet and communicate with the channel 31, thus resulting in an open state, as shown in the right of the page.

The socket structure including the valve mechanism 45C provides the same advantageous effects as the embodiment and modifications described above.

Thus, because the socket structures of the above-described embodiment and modifications of the present invention have a valve mechanism, they can be easily configured.

The present invention is not limited to the embodiment described above; it can be appropriately changed without departing from the spirit thereof.

What is claimed is:

1. A socket structure used by connecting the socket structure to a plug of a connector disposed at an outlet of a vessel for taking a fluid out of the vessel for transfer, the socket structure comprising:

a valve mechanism;

a socket body having a channel for the fluid, and a plurality of parallel gas channels disposed concentrically about the channel for the fluids which are fluidly coupled to the vessel, the channel for the fluid having a length which is substantially the same as a length of the plurality of parallel gas channels; and a sleeve in which the socket body is disposed along a central axis thereof and which is disposed so as to be slidable in an axial direction on an outer circumferential surface of the socket body, the socket structure being configured to be screwed and secured by inserting and connecting an entrance of the channel that opens at a lower end of the socket body to a plug exit that opens at an upper end of the plug and then rotating the sleeve while sliding the sleeve downward so that a sleeve thread portion is screwed into a female thread portion which is provided on the plug, wherein the valve mechanism includes a valve element, a valve shaft which is directly coupled to the valve element, and a valve-opening/closing mechanism which is directly coupled to the valve shaft, wherein the valve element reciprocates along a central axis of the channel of the socket body, and wherein the plurality of parallel gas channels and the fluid channel are integrally formed in the socket body.

2. The socket structure according to claim 1, wherein a position where the sleeve thread portion is screwed into the thread portion on the vessel side is set to be higher than a position where the entrance of the channel is connected to the plug exit.

3. The socket structure according to claim 1, wherein a screwing completion indicator is provided on the outer circumferential surface of the lower end of the socket body so that the screwing completion indicator is exposed when the sleeve thread portion is screwed to a predetermined position in the thread portion on the vessel side.

4. The socket structure according to claim 3, wherein the screwing completion indicator is provided by attaching a color ring different in color from the outer circumferential surface of the socket body or a valve body.

5. The socket structure according to claim 1, wherein a tapered surface, for forming a working space, whose diameter decreases toward a lower end thereof is provided in an outer circumferential surface of a lower end of the sleeve.

6. The socket structure according to claim 1, wherein the valve-opening/closing mechanism which is directly connected to the valve element.

7. The socket structure according to claim 1, wherein the valve-opening/closing mechanism is one of an electric actuator or a pneumatic actuator.

8. The socket structure according to claim 1, wherein a lower side of the socket body comprises: an insertion portion along an inner surfaces of the plug; an outer ring portion along outer surfaces of the plug; and a coupling surface that abuts against the upper end surface of the plug face to the socket body.

* * * * *